US008485200B1

(12) United States Patent
Levinger

(10) Patent No.: US 8,485,200 B1
(45) Date of Patent: Jul. 16, 2013

(54) COMBINATION LIGHT AND CIGAR CUTTING BLADE

(76) Inventor: Frederick N. Levinger, Palm Beach Gardens, FL (US)

( * ) Notice: Subject to any disclaimer, the term of this patent is extended or adjusted under 35 U.S.C. 154(b) by 0 days.

(21) Appl. No.: 13/370,849

(22) Filed: Feb. 10, 2012

(51) Int. Cl.
*A24F 13/20* (2006.01)

(52) U.S. Cl.
USPC ..... 131/248; 131/255; 362/253; 30/109; 7/158

(58) Field of Classification Search
USPC ..... 131/248, 255; 362/253; 30/109; 7/158
See application file for complete search history.

(56) References Cited

U.S. PATENT DOCUMENTS

| | | | | | |
|---|---|---|---|---|---|
| 376,511 | A * | 1/1888 | Carter | 131/255 |
| 1,734,620 | A * | 11/1929 | Giacopini | 131/255 |
| 5,535,763 | A | 7/1996 | Conte | |
| 5,738,117 | A | 4/1998 | Fontaine, Jr. | |
| 5,799,662 | A | 9/1998 | Conte | |
| 5,862,808 | A * | 1/1999 | Albarello | 131/255 |
| 5,888,061 | A | 3/1999 | Reynolds | |
| 6,026,574 | A | 2/2000 | Ghavami et al. | |
| 6,032,679 | A | 3/2000 | McGlauflin | |
| 6,102,047 | A | 8/2000 | Manderick | |
| 6,875,013 | B2 * | 4/2005 | Smith | 431/253 |
| 6,907,886 | B2 | 6/2005 | Kemanjian | |
| 2005/0257797 | A1 | 11/2005 | Taylor | |
| 2007/0000502 | A1 * | 1/2007 | Chong et al. | 131/249 |
| 2007/0261174 | A1 * | 11/2007 | Barker | 7/160 |
| 2009/0133705 | A1 * | 5/2009 | Smith | 131/255 |
| 2011/0146696 | A1 | 6/2011 | Dipple | |

* cited by examiner

*Primary Examiner* — Richard Crispino
*Assistant Examiner* — Dionne W Mayes
(74) *Attorney, Agent, or Firm* — Salter & Michaelson

(57) ABSTRACT

A combination light and cigar cutting blade that includes a housing having a first housing piece and a second housing piece that mates with the first housing piece when the housing pieces are assembled; a light source disposed in said first housing piece; at least one battery coupled with the light source; a switch mounted on the first housing piece coupled with the light source and battery, and having opposed positions for either activating the light source or turning the light source off; a cutting blade having an annular cutting blade surface; and an activating button mounted on the second housing piece for operating the cutting blade between a nested position in which the cutting blade is disposed within the second housing piece, and an extended position in which the cutting blade is extended from the second housing piece.

20 Claims, 5 Drawing Sheets

COMBINATION LIGHT AND CIGAR CUTTING BLADE

FIELD OF THE INVENTION

The present invention relates in general to a combination of a light source with a cigar cutting blade. More particularly, the present invention relates to a two-piece housing for respectively supporting the light source and cutting blade.

BACKGROUND OF THE INVENTION

There presently exists prior art relating to different types of cutting blades as they particularly relate to cigars. However, these cutting blades are usually associated with a cigarette or cigar lighter. Presently, there is no device that exists that is a combination of a cigar cutting blade and a light source.

Accordingly, it is an object of the present invention to provide such a combination light source and cigar cutting blade.

Another object of the present invention is to provide the aforementioned combination in a housing arrangement that enables ready activation of the light source as well as means for controlling transition of the cutting blade between nested and extended positions.

SUMMARY

The foregoing and other objects, features and advantages of the disclosure will be apparent from the following more particular description of preferred embodiments of the disclosure, as illustrated in the accompanying drawings in which like reference characters refer to the same parts throughout the different views. The drawings are not necessarily to scale, emphasis instead being placed upon illustrating the principles of the disclosure. The principles and features of this disclosure may be employed in varied and numerous embodiments without departing from the scope of the disclosure. To accomplish the foregoing and other objects, features and advantages of the present invention there is provided a combination light and cigar cutting blade, comprising: a housing including a first housing piece and a second housing piece that mates with the first housing piece when the housing pieces are assembled; a light source disposed in said first housing piece; at least one battery coupled with the light source; a switch mounted on the first housing piece coupled with the light source and battery, and having opposed positions for either activating the light source or turning the light source off; a cutting blade having an annular cutting blade surface; an activating button mounted on the second housing piece for operating the cutting blade between a nested position in which the cutting blade is disposed within the second housing piece, and an extended position in which the cutting blade is extended from the second housing piece; and a guide member fixedly supported in said second housing piece, said guide member for guiding the cutting blade between the nested and extended positions.

In accordance with other aspects of the present invention the housing pieces are assembled by means of a threaded connection therebetween; including an end cap secured to the second housing piece at a location opposite to the first housing piece; the end cap is threaded to the second housing piece and includes a loop for receiving a fastener ring; including a biasing spring disposed in the second housing piece for biasing the cutting blade to its nested position; the spring is a coil spring that surrounds the guide member; the second housing piece has a center chamber in which is disposed the guide member, spring and part of the activating button; the activating button includes a base and a button; including an o-ring disposed about the base and providing an interface between the button and a sidewall defining the chamber; the guide member includes a center disposed t-shaped bar, and a coil spring disposed about the t-shaped bar; including a first screw for attaching the t-shaped bar to a cross wall in the second housing piece and a second screw forming an end rest for one end of the coil spring; and the base forms a second opposed end rest for the opposite end of the coil spring.

Also, in accordance with the present invention there is provided a combination light and cigar cutting blade, comprising: a housing including a first housing piece and a second housing piece that mates with the first housing piece when the housing pieces are assembled; a light source disposed in said first housing piece; at least one battery coupled with the light source; a switch mounted on the first housing piece coupled with the light source and battery, and having opposed positions for either activating the light source or turning the light source off; a cutting blade having an annular cutting blade surface; an activating button mounted on the second housing piece for operating the cutting blade between a nested position in which the cutting blade is disposed within the second housing piece, and an extended position in which the cutting blade is extended from the second housing piece; and an end cap secured to the second housing piece at a location opposite to the first housing piece.

Other aspects of the present invention including a guide member fixedly supported in said second housing piece, said guide member for guiding the cutting blade between the nested and extended positions; the activating button includes a base and a button; including an o-ring disposed about the base and providing an interface between the button and a sidewall defining the chamber; the guide member includes a center disposed t-shaped bar, and a coil spring disposed about the t-shaped bar; including a first screw for attaching the t-shaped bar to a cross wall in the second housing piece and a second screw forming an end rest for one end of the coil spring; the base forms a second opposed end rest for the opposite end of the coil spring.

Finally, in accordance with the present invention there is provided a combination light and cigar cutting blade, comprising: a housing including a first housing piece and a second housing piece that mates with the first housing piece when the housing pieces are assembled; a light source disposed in said first housing piece; at least one battery coupled with the light source; a switch mounted on the first housing piece coupled with the light source and battery, and having opposed positions for either activating the light source or turning the light source off; a cutting blade having an annular cutting blade surface; an activating button mounted on the second housing piece for operating the cutting blade between a nested position in which the cutting blade is disposed within the second housing piece, and an extended position in which the cutting blade is extended from the second housing piece; a guide member fixedly supported in said second housing piece, said guide member for guiding the cutting blade between the nested and extended positions; wherein the housing pieces are assembled by means of a threaded connection therebetween; including an end cap secured to the second housing piece at a location opposite to the first housing piece; wherein the end cap is threaded to the second housing piece and includes a loop for receiving a fastener ring; including a biasing spring disposed in the second housing piece for biasing the cutting blade to its nested position; wherein the spring is a coil spring that surrounds the guide member; wherein the second housing piece has a center chamber in which is disposed the guide member, spring and part of the activating button; wherein the activating button includes a base and a button; including an o-ring disposed about the base and providing an interface between the button and a sidewall defining the chamber; wherein the guide member includes a center disposed t-shaped bar, and a coil spring disposed about the t-shaped bar; including a first screw for attaching the t-shaped bar to a cross wall in the second housing piece and a second screw forming an end rest for one end of the coil spring; and wherein the base forms a second opposed end rest for the opposite end of the coil spring.

BRIEF DESCRIPTION OF THE DRAWINGS

It should be understood that the drawings are provided for the purpose of illustration only and are not intended to define the limits of the disclosure. The foregoing and other objects and advantages of the embodiments described herein will become apparent with reference to the following detailed description when taken in conjunction with the accompanying drawings in which.

DETAILED DESCRIPTION OF THE PREFERRED EMBODIMENTS

Figure 1:
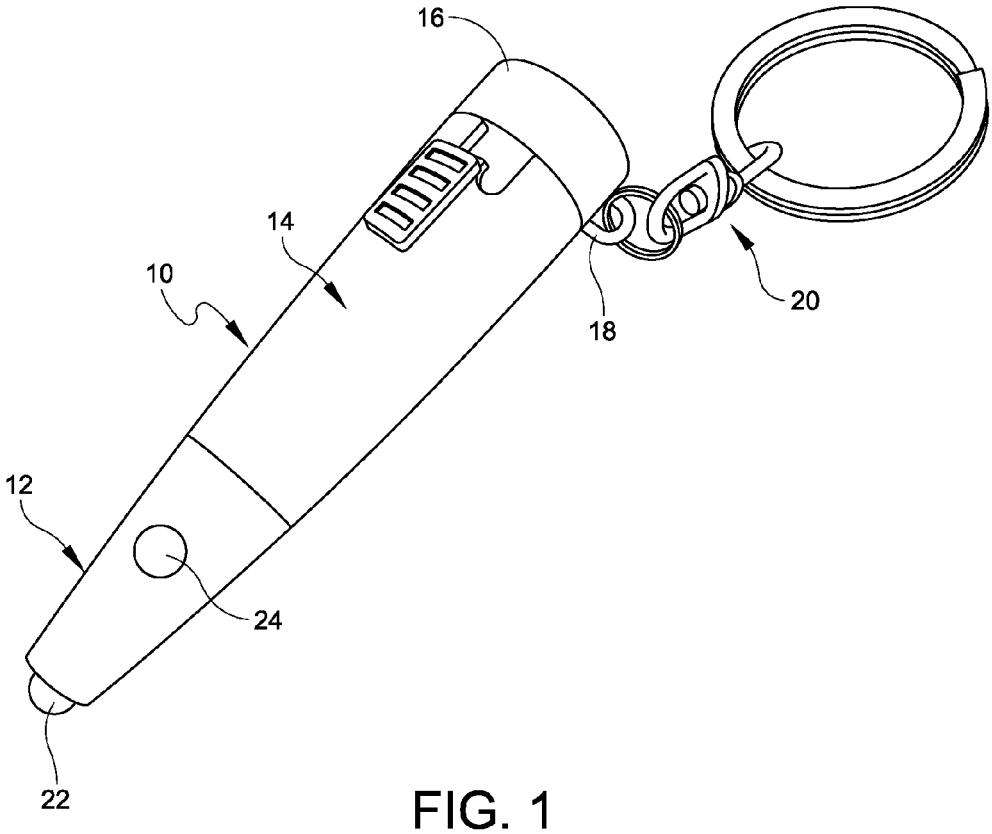
FIG. 1 is a perspective view of the device of the present invention.

The following description is presented to enable any person skilled in the art to make and use the invention. Descriptions of specific embodiments and applications are provided only as examples and various modifications will be readily apparent to those skilled in the art. The general principles defined herein may be applied to other embodiments and applications without departing from the spirit and scope of the invention. Thus the present invention is to be accorded the widest scope encompassing numerous alternatives, modifications and equivalents consistent with the principles and features disclosed herein. For purpose of clarity, details relating to technical material that is known in the technical fields related to the invention have not been described in detail so as not to unnecessarily obscure the present invention Reference is now made to the drawings and in particular FIGS. 1-3 which illustrate the combination light and cigar cutting blade at 10. For details of the device, refer to the exploded perspective view of FIG. 4 and the two cross-sectional views of respective FIGS. 5 and 6. The device 10 is comprised of a two-piece housing including a first housing piece 12 and a second housing piece 14. These housing pieces may be threaded together such as illustrated in FIG. 5 at 15. At the end of the housing piece 14, remote from the housing piece 12, there is an end cap 16. The end cap 16 is also preferably threadedly engaged with the housing piece 14 as illustrated in, for example, FIG. 5 at 17. The end cap 16 is provided with an integral flange 18 to which may be attached a key ring structure illustrated at 20 in the drawings.

A distal end of the housing piece 12 is open for receiving a light source 22 disposed in this opening. The light source 22 is preferably an LED that is activated by means of depressing the activation button 24. The housing piece 12 is substantially hollow and thus has sufficient room to house the LED source 22 as well as the switching mechanism associated with the button 24. Also, the larger housing piece 14 is substantially hollow with an intermediate wall 19 separating the housing into two separate compartments. One compartment houses a series of batteries such as illustrated in FIG. 5 at 25. These batteries may be stacked in series and complete a circuit with the button 24 for either turning the LED light on or off. The button 24 would be biased to its extended position keeping the light source off but may be depressed as shown in FIG. 5 in order to complete the circuit between the battery and the light source for illuminating the light source. Within the housing piece 14, on the side of the wall 19 opposite to the batteries 25, is disposed the cutting blade mechanism.

Figure 2:
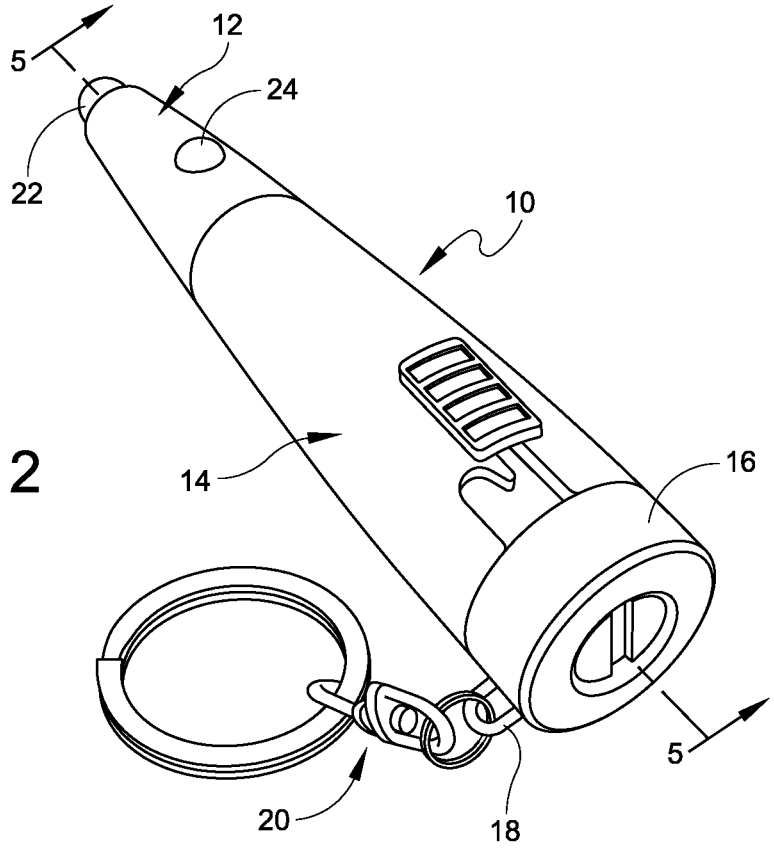
FIG. 2 is a perspective view taken in the opposite direction at the cutting blade end of the device with the cutting blade in its nested position.
Figure 3:
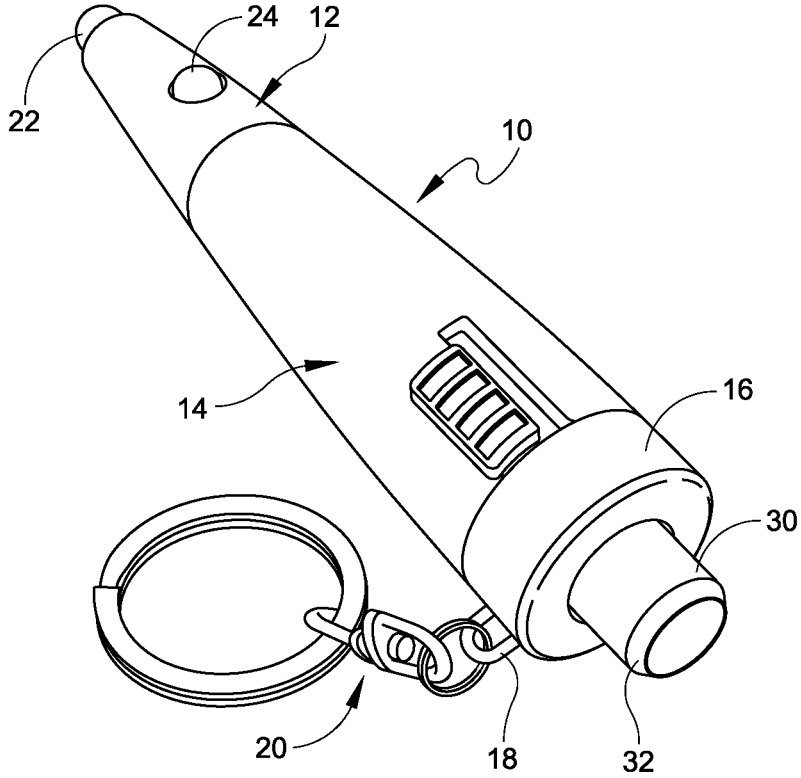
FIG. 3 is a perspective view similar to that shown in FIG. 2 but with the cutting blade in its extended position.
Figure 4:
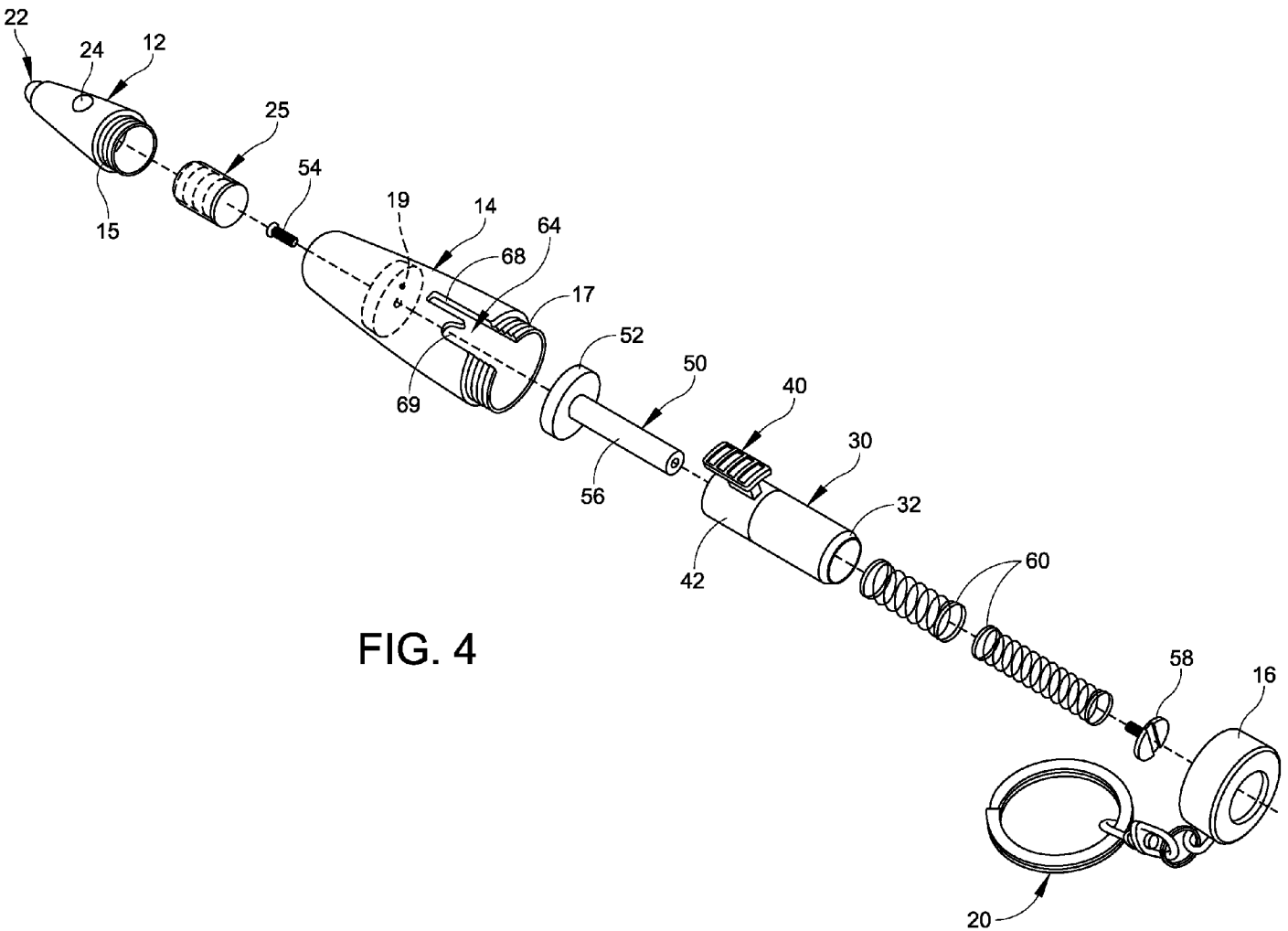
FIG. 4 is an exploded perspective view of the device illustrated in FIGS. 1-3.
Figure 5:
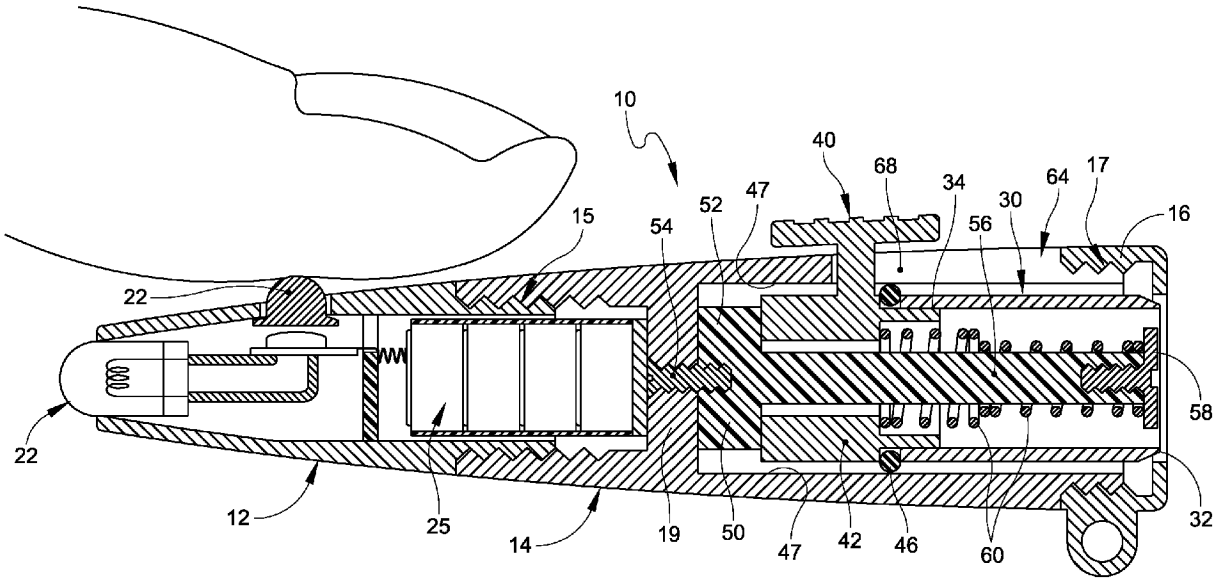
FIG. 5 is a cross-sectional view taken along line 5-5 of FIG. 2.
Figure 6:
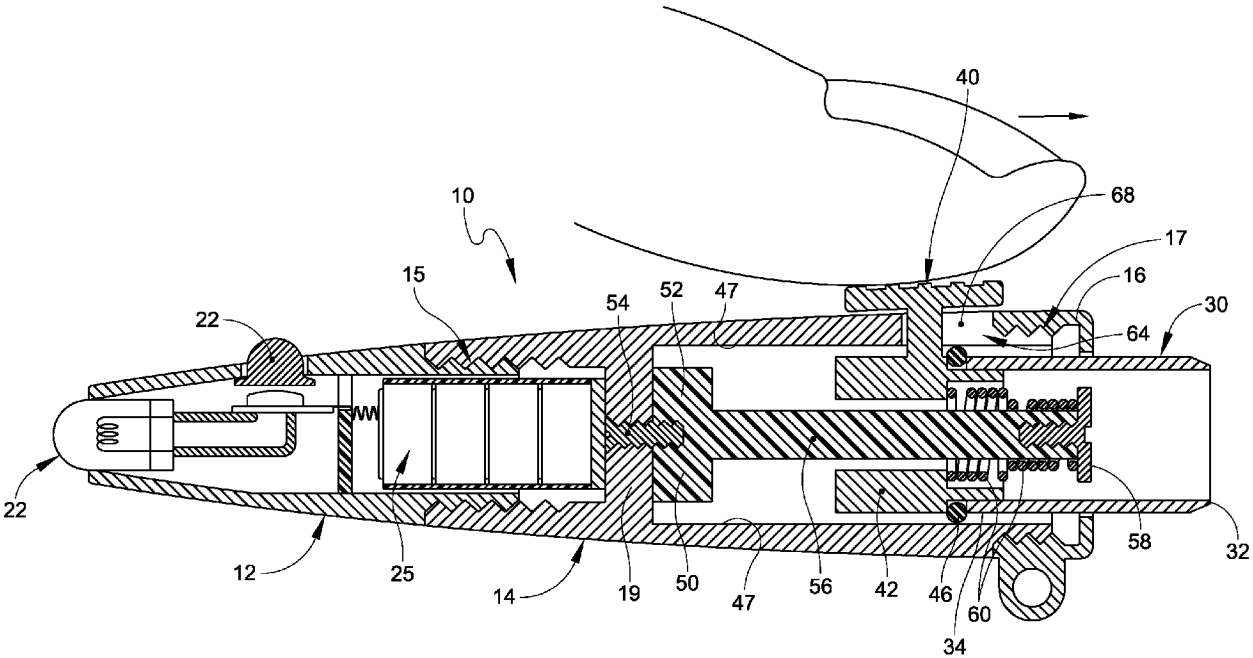
FIG. 6 is a cross-sectional view like that shown in FIG. 5 but with the cutting blade in its extended position.

With further reference to the details illustrated in FIGS. 4-6, there is illustrated the cutting blade in the form of an annular cutting blade 30. FIGS. 2 and 5 illustrate the cutting blade 30 in its nested position, while FIGS. 3 and 6 illustrate the cutting blade 30 in an extended and locked position. The cutting blade 30 is annular in shape having a circular cutting surface at 32 and a base 34 that is supported at the sliding mechanism for transitioning of the cutting blade. This mechanism includes a slide switch 40 mounted on a base 42. The activating button 40 or slide switch is mounted on the housing piece 14 for operating the cutting blade between a nested position in which the cutting blade is disposed within the housing piece, as illustrated in FIG. 5, or an extended position in which the cutting blade is extended from the housing piece 14, such as illustrated in FIG. 6. Thus, the base 34 of the cutting blade 30 is fixed with the base 42 of the activating button 40. An O-ring 46 is disposed between the base 34 and the base 42. The O-ring is adapted to slide on an inner surface 47 of the internal chamber formed within the housing piece 14. Thus, the O-ring 46 also functions as an outer guide for the transitional movement of the cutting blade 30.

FIGS. 5 and 6 also illustrate a guide member 50 which is a t-shaped member. The base 52 of the guide member 50 is secured to the wall 19 by means of a screw 54. The guide member 50 also includes an elongated arm 56 that extends concentrically within the hollow chamber of the housing piece 14. The elongated arm 56 extends through the base 42 and concentrically relative to the annular cutting blade 30. A second screw 58 is secured at the end of the elongated arm 56.

One or more coil springs 60 are disposed about the arm 56. At one end, the coil springs 60 are abutted up against the head of the screw 58. At the other end of the coil springs 60 they rest against a ledge provided in the base 42. The one or more coil springs 60 bias the activating button 40 to the left as viewed in FIG. 5. Thus, the coil springs 60 normally bias the cutting blade to its nested position as illustrated in FIG. 5.

In order to transition the cutting blade between the nested and extended positions, the knob 40 is constructed and arranged so that it passes through a slot 64 in the housing piece 14. The slot 64 may have a generally u-shaped configuration including separate slots 68 and 69 as depicted in FIG. 4. These separate slots are for securing the cutting blade in respective nested and extended positions. Thus, the slot structure 64 has a somewhat longer slot 68 where the knob is positioned in the nested position, as well as a second shorter length slot 69 where the knob is positioned and supported in the extended or in-use position. As mentioned previously, the springs 64 are positioned between the housing piece and the guide member 50 for normally biasing the cutting blade to its nested or retracted position.

In use, the punch-style cutting blade 30 is activated by a user grasping the knob 40 and moving it within the slot structure 64 from the first slot 68 to the second slot 69 so that the cutting end is moved from the retracted position where it is preferably substantially flush with the bottom end of the housing piece 14 to the operative or cutting position where it extends from the housing piece 14. Once the knob is supported in this second slot 69 so that the cutting end is extended, the user can insert the cutting end into the closed end of the cigar, so as to "punch" or cut a hole in the closed end of the cigar.

Having now described a limited number of embodiments of the present invention, it should now be apparent to those skilled in the art that numerous other embodiments and modifications thereof are contemplated as falling within the scope of the present invention, as defined by the appended claims.

What is claimed is:

1. A combination light and cigar cutting blade, comprising:
- a housing including a first housing piece and a second housing piece that mates with the first housing piece when the housing pieces are assembled;
- a light source disposed in said first housing piece;
- at least one battery coupled with the light source;
- a switch mounted on the first housing piece coupled with the light source and battery, and having opposed positions for either activating the light source or turning the light source off;
- a cutting blade having an annular cutting blade surface;
- an activating button mounted on the second housing piece for operating the cutting blade between a nested position in which the cutting blade is disposed within the second housing piece, and an extended position in which the cutting blade is extended from the second housing piece;
- a guide member fixedly supported in said second housing piece, said guide member for guiding the cutting blade between the nested and extended positions;
- wherein the activating button includes a base and a button; and
- a ring member disposed about the activation button base and providing an interface between the button and an inner surface of the housing so as to enable the ring member to slide on the inner surface.

2. The combination of claim 1 wherein the housing pieces are assembled by means of a threaded connection therebetween.

3. The combination of claim 1 including an end cap secured to the second housing piece at a location opposite to the first housing piece.

4. The combination of claim 3 wherein the end cap is threaded to the second housing piece and includes a loop for receiving a fastener ring.

5. The combination of claim 1 including a biasing spring disposed in the second housing piece for biasing the cutting blade to its nested position.

6. The combination of claim 5 wherein the spring is a coil spring that surrounds the guide member.

7. The combination of claim 1 wherein the second housing piece has an internal chamber in which is disposed the guide member and part of the activating button.

8. The combination of claim 1 wherein the ring member comprises an o-ring.

9. A combination light and cigar cutting blade, comprising:
- a housing including a first housing piece and a second housing piece that mates with the first housing piece when the housing pieces are assembled;
- a light source disposed in said first housing piece;
- at least one battery coupled with the light source;
- a switch mounted on the first housing piece coupled with the light source and battery, and having opposed positions for either activating the light source or turnip the light sour
- a cutting blade having an annular cutting blade surface;
- an activating button mounted on the second housing piece for operating the cutting blade between a nested position in which the cutting blade is disposed within the second housing piece, and an extended position in which the cutting blade is extended from the second housing piece;
- wherein the activating button includes a base and a button; and
- an o-ring disposed about the base and providing an interface between the button and a sidewall defining an internal chamber.

10. The combination of claim 9 wherein the guide member includes a center disposed t-shaped bar, and a coil spring disposed about the t-shaped bar.

11. The combination of claim 10 including a first screw for attaching the t-shaped bar to a cross wall in the second housing piece and a second screw forming an end rest for one end of the coil spring.

12. The combination of claim 11 wherein the base forms a second opposed end rest for the opposite end of the coil spring, and the second housing piece has a u-shaped slot with adjacent slots for receiving the button in opposed respective nested and extended positions.

13. A combination light and cigar cutting blade, comprising:
- a housing including a first housing piece and a second housing piece that mates with the first housing piece when the housing pieces are assembled;
- a light source disposed in said first housing piece;
- at least one battery coupled with the light source;
- a switch mounted on the first housing piece coupled with the light source and battery, and having opposed positions for either activating the light source or turning the light source off;
- a cutting blade having an annular cutting blade surface;
- an activating button mounted on the second housing piece for operating the cutting blade between a nested position in which the cutting blade is disposed within the second housing piece, and an extended position in which the cutting blade is extended from the second housing piece;
- an end cap secured to the second housing piece at a location opposite to the first housing piece;
- wherein the activating button includes a base and a button; and
- a ring member disposed about the activation button base and providing an interface between the button and an inner surface of the housing so as to enable the ring member to slide on the inner surface.

14. The combination of claim 13 including a guide member fixedly supported in said second housing piece, said guide member for guiding the cutting blade between the nested and extended positions.

15. The combination of claim 13 wherein the ring member comprises an o-ring.

16. A combination light and cigar cutting blade, comprising:

a housing including a first housing piece and a second housing piece that mates with the first housing piece when the housing pieces are assembled;

a light source disposed in said first housing piece;

at least one battery coupled with the light source;

a switch mounted on the first housing piece coupled with the light source and battery, and having opposed positions for either activatin the light source or turning the light source off;

a cutting blade having an annular cutting blade surface;

an activating button mounted on the second housing piece for operating the cutting blade between a nested position in which the cutting blade is disposed within the second housing piece, and an extended position in which the cutting blade is extended from the second housing piece;

wherein the activating button includes a base and a button; and an o-ring disposed about the base and providing an interface between the button and a sidewall defining an internal chamber.

17. The combination of claim 16 wherein the guide member includes a center disposed t-shaped bar, and a coil spring disposed about the t-shaped bar.

18. The combination of claim 17 including a first screw for attaching the t-shaped bar to a cross wall in the second housing piece and a second screw forming an end rest for one end of the coil spring.

19. The combination of claim 18 wherein the base forms a second opposed end rest for the opposite end of the coil spring.

20. A combination light and cigar cutting blade, comprising:

a housing including a first housing piece and a second housing piece that mates with the first housing piece when the housing pieces are assembled;

a light source disposed in said first housing piece;

at least one battery coupled with the light source;

a switch mounted on the first housing piece coupled with the light source and battery, and having opposed positions for either activating the light source or turning the light source off;

a cutting blade having an annular cutting blade surface;

an activating button mounted on the second housing piece for operating the cutting blade between a nested position in which the cutting blade is disposed within the second housing piece, and an extended position in which the cutting blade is extended from the second housing piece;

a guide member fixedly supported in said second housing piece, said guide member for guiding the cutting blade between the nested and extended positions;

wherein the housing pieces are assembled by means of a threaded connection therebetween;

including an end cap secured to the second housing piece at a location opposite to the first housing piece;

wherein the end cap is threaded to the second housing piece and includes a loop for receiving a fastener ring;

including a biasing spring disposed in the second housing piece for biasing the cutting blade to its nested position;

wherein the spring is a coil spring that surrounds the guide member;

wherein the second housing piece has a center chamber in which is disposed the guide member, spring and part of the activating button;

wherein the activating button includes a base and a button;

including an o-ring disposed about the base and providing an interface between the button and a sidewall defining the chamber;

wherein the guide member includes a center disposed t-shaped bar, and a coil spring disposed about the t-shaped bar;

including a first screw for attaching the t-shaped bar to a cross wall in the second housing piece and a second screw forming an end rest for one end of the coil spring;

wherein the base forms a second opposed end rest for the opposite end of the coil spring and the second housing piece has a u-shaped slot with adjacent slots for receiving the button in opposed respective nested and extended positions.

* * * * *